US008948907B2

(12) United States Patent
Ugarte Barrena et al.

(10) Patent No.: US 8,948,907 B2
(45) Date of Patent: Feb. 3, 2015

(54) METHOD FOR LOADING CONTAINERS

(75) Inventors: Josu Ugarte Barrena, Onati (ES); Eneko Izquierdo Ereno, Onati (ES)

(73) Assignee: Ulma Packaging Technological Center, S. Coop., Onati (Guipuzcoa) (ES)

( * ) Notice: Subject to any disclaimer, the term of this patent is extended or adjusted under 35 U.S.C. 154(b) by 441 days.

(21) Appl. No.: 13/318,888

(22) PCT Filed: May 6, 2009

(86) PCT No.: PCT/ES2009/070144

§ 371 (c)(1),
(2), (4) Date: Nov. 4, 2011

(87) PCT Pub. No.: WO2010/128174

PCT Pub. Date: Nov. 11, 2010

(65) Prior Publication Data

US 2012/0059507 A1 Mar. 8, 2012

(51) Int. Cl.

| | |
|---|---|
| ***G06F 7/00*** | (2006.01) |
| ***B65B 5/10*** | (2006.01) |
| ***B65B 57/06*** | (2006.01) |

(52) U.S. Cl.

CPC ..... *B65B 5/105* (2013.01); *B65B 57/06* (2013.01)

USPC ..... 700/214; 700/217; 209/629; 395/13

(58) Field of Classification Search

CPC ..... G11B 17/225; G11B 15/689; G11B 15/6835; G11B 17/228; G06Q 10/087

USPC ..... 700/213

See application file for complete search history.

(56) References Cited

U.S. PATENT DOCUMENTS

| | | | | |
|---|---|---|---|---|
| 5,041,907 | A * | 8/1991 | Sager et al. | 348/91 |
| 5,390,283 | A * | 2/1995 | Eshelman et al. | 706/13 |
| 5,623,810 | A | 4/1997 | Dey et al. | |
| 6,122,895 | A * | 9/2000 | Schubert | 53/55 |
| 6,769,228 | B1 * | 8/2004 | Mahar | 53/411 |

(Continued)

FOREIGN PATENT DOCUMENTS

| | | |
|---|---|---|
| DE | 297 01 564 | 3/1997 |
| DE | 10 2005 023810 | 11/2006 |

OTHER PUBLICATIONS

International Search Report, dated Jan. 12, 2010, from International Application No. PCT/ES2009/070144.

*Primary Examiner* — Gene Crawford
*Assistant Examiner* — Kyle Logan
(74) *Attorney, Agent, or Firm* — Time L. Kitchen; Peter B. Scull; Hamilton DeSanctis & Cha LLP

(57) ABSTRACT

A method for loading containers that involves intermittently shifting at least one first empty housing and one second empty housing of the containers between respective first and second rest positions. According to one embodiment the method involves calculating an available time td corresponding to the time necessary for an empty housing to reach a loading position of a manipulator and comparing the available time td with a positioning time necessary for the manipulator to collect from its current position each object to be loaded from a collecting area and depositing it in a loading position coinciding with the position of an empty housing of a container. The object to be collected and the delivery position of the object in an empty housing corresponds with a loading position of the manipulator in which the positioning time is closest to the available time td.

12 Claims, 1 Drawing Sheet

(56) References Cited

U.S. PATENT DOCUMENTS

| | | | | |
|---|---|---|---|---|
| 8,565,912 | B2 * | 10/2013 | Wappling et al. | 700/217 |
| 2002/0157919 | A1 | 10/2002 | Sherwin | |
| 2003/0037515 | A1 * | 2/2003 | Herzog | 53/473 |
| 2005/0075752 | A1 * | 4/2005 | Ban et al. | 700/213 |
| 2007/0007924 | A1 * | 1/2007 | Nishihara et al. | 318/560 |
| 2007/0108109 | A1 * | 5/2007 | Erlandsson-Warvelin et al. | 209/629 |
| 2008/0190075 | A1 | 8/2008 | Waeckerlin | |

* cited by examiner

METHOD FOR LOADING CONTAINERS

FIELD OF THE INVENTION

The present invention is comprised within the field of the devices and methods for loading products in containers or receptacles which are shifted moved by shifting means and, more specifically, intermittently advancing containers in which the products are loaded by means of manipulators.

BACKGROUND

In many packaging processes the movement of the containers throughout the installation is performed intermittently due to the transformation processes (such as, for example, forming or sealing) which the receptacle experiences in the different stations or machines. This intermittent movement makes it difficult to efficiently load the products in the receptacles or containers since once the loading movement starts, the receptacle or container cannot advance until the loading has completed, causing idle time in the packaging process.

The products to be loaded generally arrive by a conveyor belt parallel to the loading station of the machine, in which it is increasingly more common to find robots loading the product in the housings of the container or receptacle. These robots grab a product or a group of products from said belts and deliver it in the housings of the previously formed container or receptacle. It is also common for the products to advance in the direction opposite to the advance of the receptacles (counter flow), although installations are also known in which the products advance in the same advance direction of the receptacles.

Currently, loading is performed with the container or receptacle stopped (in the pauses of the intermittent movement during which the forming, filling, sealing, cutting and extraction operations, among others, are performed in the subsequent parts of the machine) and the receptacle or container can comprise several housings which must be filled during the mentioned pause in the advance of the container. Thus, for example, if the receptacle to be filled has four housings and the manipulator has only been able to fill 3 of the 4 housings in the current cycle (pause of the intermittent movement) but has not had time to fill the fourth housing, the machine must delay its advance until the robot delivers the last product in the corresponding housing (for example in the fourth housing). This delay in the advance reduces productivity of the machine due to the accumulation of delay times.

To prevent these delays or idle times, there are alternatives based on the robot following the receptacle during its advance.

A solution to this problem consists of preventing the machine from remaining stopped until all the products have been loaded in their housings, making the manipulator move, following the housing to be filled during the advance of the machine and performing the loading with the moving receptacle. This is very common in continuous processes, for example, in the automotion sector.

However, in certain machines of the packaging sector, such as, for example, the thermoforming machines, no transformation conferring an added value to the receptacle/product is performed during the advance of the receptacles, therefore shifting from one station of the machine to another should be done as quickly as possible in order to eliminate these idle times. To that end, in these cases the advance speeds of the machine, and therefore of the receptacles, follow a very marked acceleration-deceleration curve. In this case the course taken by the robot while it follows a housing of the moving receptacle to deposit the product is very long since the robot will change its direction vector as it detects point-to-point the new positions of the housing. As a result, the manipulator will follow a curved path, seen in plan view, which means greater time and space traveled to reach the housing in which it will finally deposit the product, the case in which the robot reaches the housing once the advance has ended, or even later in very fast machines, possibly occurring. Therefore, in this case the course of the robot is not optimized and the excess time involves a reduction of the productivity of the robot.

The present invention seeks to optimize the productivity of the machine and to also optimize the excess time used by the robot to increase its productivity.

SUMMARY OF THE DISCLOSURE

An object of the invention is a method for loading containers comprising at least one first empty housing and one second empty housing configured to receive an object to be loaded, the mentioned containers being intermittently shiftable by shifting means such that the containers can occupy a first rest position, during a rest time tr, and can be shifted, during an advance time ta, from the first rest position to at least one second rest position. The shifting of the containers is performed with a variable velocity (velocity with a non-constant acceleration) throughout the advance time ta. The loading of the object is performed by means of at least one manipulator (for example a robot) which can collect the object to be loaded from a collecting area, comprising at least one object, and deliver it in a loading position coinciding with one of the empty housings of one of the containers. A collecting area is a position within the work area of the manipulator in which the object or the objects which are collected for subsequent loading are located. The objects to be collected can be, for example in a product warehouse, or on a conveyor belt shifting the objects at a certain velocity. A loading position is a position which is within the work area of the manipulator and in which the delivery of products is provided, the manipulator being able to reach, for example, four different loading positions (first, second, third and fourth loading position) and these loading positions spatially coincide with the location of one of the empty housings of one of the containers, such that the loading of the manipulator in a loading position causes the product to be loaded in a housing of a receptacle.

The method of the invention comprises the following phases:

Calculating an available time td corresponding to the time necessary for an empty housing of a container to reach a loading position, Calculating for each of the mentioned at least one object (comprised in the collecting area at the time of collection):

- a positioning time tp11 necessary for the manipulator to reach a first loading position coinciding with the position of a first empty housing of a container,
- a positioning time tp12 necessary for the manipulator to reach a second loading position coinciding with the position of a second empty housing of a container,
- a positioning time tp21 necessary for the manipulator to reach a third loading position coinciding with the position of a first empty housing of a container,
- a positioning time tp22 necessary for the manipulator to reach a fourth loading position coinciding with the position of a second empty housing of a container.

Then the available time td is compared with the positioning times tp11, tp12, tp21 and tp22 of each of the at least one object (a, b, c, d) in each of the loading positions (11, 12, 21, 22) to determine an object to be collected and a loading position the positioning time tp11, tp12, tp21 or tp22 of which is closest to the available time td.

Finally, the manipulator delivers said object in said collecting position (after collecting the object from the collecting position).

According to the method of the invention, the movement of the containers between a first rest position and a second rest position, and more specifically, the time necessary for the empty housings of the containers to reach a loading position, are taken into account. Based on this data it calculates and decides which object is going to be collected (in the event that there is more than one object in the collecting area) and in which loading position the manipulator will deliver the object, which loading position will obviously coincide with an empty housing of a container.

To that end, the positioning times tp11, tp12, tp21 and tp22 of each object (the time the manipulator needs in the current position to collect each of the objects comprised in the collecting area and take them to each empty housing in the pre-established possible loading positions) are calculated and these times are compared with the available time td (the time necessary for the empty housing of the container to reach a loading position). Out of the possible objects to be collected and the possible loading positions in which to deposit the objects, one object will be chosen and it will be deposited in a loading position having a positioning time which is closest to the available time. In other words, the manipulator will collect an object and load it in a loading position based on which of all the positioning times tp11, tp12, tp21 and tp22 calculated for each object and for each of the loading positions is closest to the available time td. This calculation is constantly performed such that the manipulator chooses the objects to be collected and loads said objects, always optimizing the necessary positioning time, instead of maintaining a pre-established sequence when collecting the objects to be loaded, or a pre-established loading order in a loading position without taking into account mismatching between the positioning time of the manipulator and the movement of the container.

The manipulator can shift from the collecting position to the loading position following a rectilinear path, seen from above, to minimize positioning times.

The first, second, third and fourth loading positions can coincide with the position of an empty housing of a container in the first or second rest position, such that the loading of the products is performed when the containers are at rest, or they can coincide with positions intermediate between the first and second rest position, such that the loading is performed during the advance of the containers.

The method of the invention can comprise tracking the path of the housings when there is a certain phase difference between the loading position (theoretical) and the position of the empty housings, or when the positioning times tp11, tp12, tp21 and tp22 are less than the available time td, i.e., in these conditions the method of invention would comprise tracking the housings. This tracking of the path can comprise a first shifting of the manipulator consisting of shifting in a straight line, seen in plan view, to a position close to the housing and a second shifting of the manipulator consisting of tracking the position of the housing. In the cases that the product is deposited in a housing of a container that is still moving, the manipulator adapts its velocity and direction to those of the container at the time of the delivery.

Another object of the invention is a packaging machine comprising shifting means which can intermittently shift containers such that the containers can occupy a first rest position, during a rest time tr, and can be shifted, during an advance time ta, from the first rest position to at least one second rest position, said shifting of the containers being performed with a variable velocity throughout the advance time ta. The containers comprise at least one first housing and one second housing configured to receive an object to be loaded, the mentioned machine comprising at least one manipulator which can collect an object to be loaded from a collecting area comprising at least one object, and deliver it in one of the housings of one of the containers. The machine furthermore comprises a control system and means of communication between the shifting means and the at least one manipulator, configured such that the at least one object to be loaded is deposited in one of the empty housings according to a loading method according to any of the previous claims.

The packaging machine can comprise a thermoforming and/or heat-sealing station.

BRIEF DESCRIPTION OF THE DRAWING

To complement the description being made and for the purpose of aiding to better understand the features of the invention according to a preferred practical embodiment thereof, a set of drawings is attached as an integral part of said description in which the following is depicted with an illustrative and non-limiting character.

DETAILED DESCRIPTION

Figure 1:
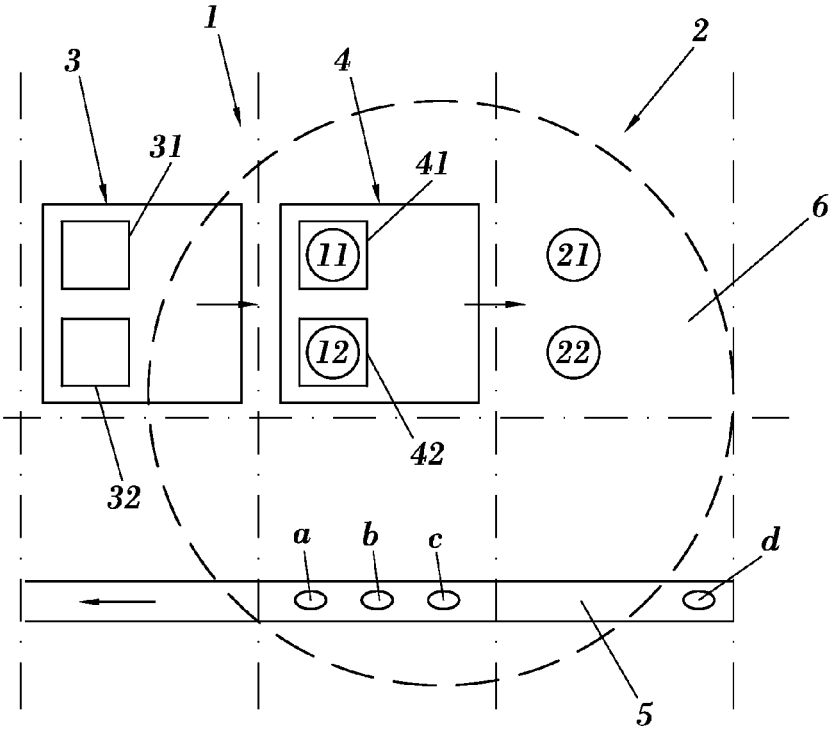
FIG. 1 shows a schematic depiction of two containers (3, 4) comprising empty housings (31, 32) (41, 42), container (4) being in the first rest position (1) and housings (41 and 42) coinciding with loading positions (11, 12) of the manipulator.
Figure 2:
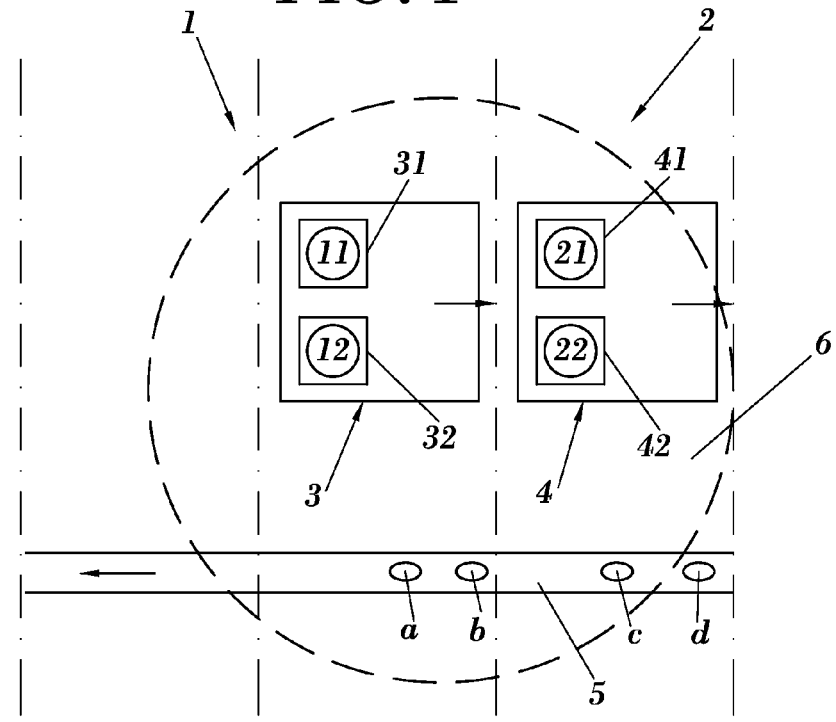
FIG. 2 shows a schematic depiction similar to that of FIG. 1 in which containers (3) and (4) have advanced, container (3) being in the first rest position (1) and container (4) in the second rest position (2). In this situation, housings (31 and 32) coincide with loading positions (11 and 12) and housings (41, 42) coincide with loading positions (21, 22).

According to an embodiment shown in FIGS. 1 and 2, the method of the invention allows loading products (a, b, c, d) in empty housings (31, 41, 32, 42) of containers (3, 4). The mentioned containers (3, 4) are shifted intermittently by shifting means such that the containers (3, 4) can occupy a first rest position (1), during a rest time tr, and can be shifted, during an advance time ta, from the first rest position (1) to at least one second rest position (2). The shifting of the containers (3, 4) is performed with a variable velocity throughout the advance time ta, the loading of the object (a, b, c, d) being performed by means of at least one manipulator which can collect the object to be loaded from a collecting area (5) comprising at least one object (a, b, c, d), and deliver it in a loading position (11, 12, 21, 22) coinciding with one of the empty housings (31, 32) (41, 42) of one of the containers (3, 4). The collecting area is comprised within the work area (6) of the manipulator or manipulators. The loading positions (11, 12, 21, 22) can coincide with the position of the empty housings (31, 32, 41, 42) in the first rest position (1) and in the second rest position (2) as shown in FIGS. 1 and 2, or they can be located at an intermediate point between the first and the second rest position (1, 2) where the housings (31, 32, 41, 42) of the containers (3, 4) are shifted during the advance of the machine. In a preferred and non-excluding embodiment of the present invention, a collecting area comprising a conveyor belt (5) on which objects to be collected (a, b, c, d) move at a constant velocity and in a direction opposite to the advance of the machine is shown. One or more objects on said conveyor belt (5) can be found outside the work area of the manipulator, as seen in FIG. 1. However, said objects (d) initially located outside the work area of the manipulator can be shifted to the work area (6) of the manipulator such that those objects (d) which can reach said work area (6) when the manipulator starts to perform the collection will also be taken into account when performing the calculations of the positioning times.

In other realizations the collecting area can comprise a different number of products or even a single product. The containers (3, 4) can also comprise a different number of empty housings (for example 4, 6 etc). Only two rest positions (1,2) for the containers (3, 4) have been shown in the figures, but these rest positions can comprise a third or more rest positions.

The method comprises the following phases:

1—Calculating an available time td corresponding to the time necessary for an empty housing (31, 32, 41, 42) of a container (3, 4) to reach a loading position (11, 12, 21, 22), 2—Calculating for each of the mentioned at least one object (a, b, c, d):

a) a positioning time tp11 necessary for the manipulator to reach a first loading position (11) coinciding with the position of a first empty housing (31, 41) of a container (3, 4). The positioning times tp11*a*, tp11*b*, tp11*c* and tp11*d* would be obtained b) a positioning time tp12 necessary for the manipulator to reach a second loading position (12) coinciding with the position of a second empty housing (32, 42) of a container (3, 4). The positioning times tp12*a*, tp12*b*, tp12*c* and tp12*d* would be obtained c) a positioning time tp21 necessary for the manipulator to reach a third loading position (21) coinciding with the position of a first empty housing (31, 41) of a container (3, 4). The positioning times tp21*a*, tp21*b*, p21*c* and tp21*d* would be obtained d) a positioning time tp22 necessary for the manipulator to reach a fourth loading position (22) coinciding with the position of a second empty housing (32, 42) of a container (3, 4). The positioning times tp22*a*, tp22*b*, tp22*c* and tp22*d* would be obtained 3—Comparing the available time td with the positioning times tp11*a*, tp12*a*, tp21*a*, tp22*a* tp11*b*, tp12*b*, tp21*b*, tp22*b* tp11*c*, tp12*c*, tp21*c*, tp22*c* tp11*d*, tp12*d*, tp21*d*, tp22*d* to determine a loading position (11, 12, 21, 22) of the manipulator and an object to be loaded (a, b, c, d) the positioning time of which is closest to the available time td. In other words, it decides which of the objects (a, b, c, d) is going to be collected and in which housing the object will be loaded in.

4—Delivering said object (a, b, c, d) in said loading position (11, 12, 21, 22).

In a first embodiment the available time td, and the positioning times tp11, tp12, tp21 and tp22, of each object (a, b, c, d) can be calculated from the detection of the start of the movement of the containers (3, 4) between a first rest position (1) and the at least one second rest position (2). This case is applicable, for example, when an operator can force the start of the advance of the machine, or when it is difficult to accurately establish the performance of the advance of the machine and the products that must be loaded in the rest positions.

In this embodiment, while the machine advances, the manipulator introduces the products in the different empty housings, loading the products with the containers stopped, but, for example, the advance of the container can be started when the manipulator has finished loading one of the two housings of a container and the second housing is starting to be filled. Unlike in the state of the art, at the time that the manipulator detects that the advance of the machine (and accordingly of the containers) occurs, it will recalculate the delivery position and go directly to the corresponding empty housing, without tracking the housing it was trying to load. Likewise, if the advance of the machine occurs when the manipulator is going to collect an object (a, b, c, d), the positioning times tp11, tp12, tp21, tp22 of all the objects which at the time of collection are in the work area (6) will be recalculated, and the object to be collected and the loading position in which to deposit it are determined depending on which of all the positioning times tp11*a*1, tp12*a*, tp21*a*, tp22*a* tp11*b*, tp12*b*, tp21*b*, tp22*b* tp11*c*, tp12*c*, tp21*c*, tp22*c* tp11*d*, tp12*d*, tp21*d*, tp22*d* is most similar to the available time td.

Assume, for example, that the manipulator collects an object to be loaded and starts the movement towards a target loading position (11, 12, 21, 22), corresponding to an empty housing (31, 41, 32, 42) of a container (3, 4). In this embodiment, when the start of the advance of the machine is detected, the new positioning times tp11, tp12, tp21 and tp22 are calculated taking into account the current position of the manipulator, and the loading position (11, 12, 21, 22) is recalculated comparing said positioning times tp11, tp12, tp21 and tp22 with the time that the containers will need to reach the rest positions (the available time td to end the advance of the machine). Based on this calculation it decides whether to maintain the target loading position, perform the delivery of the product in a new loading position, or whether to choose another loading position considering distance criteria regarding the radius of action of the manipulator, complete the filling of all the housings, or others.

In this case, the manipulator can choose to not vary its path, performing the delivery in the same loading position (11, 12, 21, 22) as before the advance of the machine, and deposit the product in a new empty housing which will take the place of the empty housing which has advanced to a second rest position; it can also vary its path and got to a new loading position which corresponds with the new position which the target empty housing will occupy, once the advance of the machine has ended (going directly to the final position of said housing without tracking the same during the advance); or it can choose to perform the delivery of the object in a loading position in which any other empty housing is located, in which case it will also go directly to the final loading position, instead of tracking or making a curved path during the advance of the machine.

Keeping with the previous example, in the event that when the advance of the machine is detected the positioning time most similar to the available time td corresponds with the time necessary for reaching the same target loading position before starting the advance movement, the housing in which the delivery was to be performed before the advance will continue to be empty in a second loading position, since the product will be deposited in the empty housing of another container which will reach the target position after the advance of the machine. Likewise, if when the advance of the machine is detected the available time td corresponds with the time the manipulator needs to reach from its current position the new position which the target housing will occupy after the advance of the machine, the manipulator will go directly to the new loading position (without tracking the housing). By the same logic, it can also occur that the new target housing is different from any of those explained above, or even that other loading criteria which can be combined with the method of the present invention take precedence, such as for example completing the filling of all the housings before they leave the work area (6) of the manipulator, distance criteria with respect to the radius of action of the manipulator, or others.

When in the case of the previous example the advance movement of the machine is detected without the manipulator having any object to be loaded, the positioning time of all the objects (a, b, c, d) that may be within the collecting area (5) comprised in the work area (6) of the manipulator in the moment of the collection will be calculated. In other words, those objects which, though outside the work area of the manipulator at the precise moment of detecting the advance of the machine, may be shifted to the collecting area (5) during the time the manipulator needs to reach from its current position to the position of the object in said collecting area, and the positioning times of each object in each housing will be compared with the available time td for collecting the object (a, b, c, d) the positioning time tp11, tp12, tp21, tp22 of which in a determined loading position (11, 12, 21, 22) is the closest to the available time td. As in the previous example, in this case can also take precedence other criteria such as the priority in the collection (i.e., prioritize the collection of those objects which are going to leave the work area of the manipulator) when choosing the object to be loaded, or others.

According to the method, the machine already knows beforehand where the empty housings are located once the advance (both those of the container having all the empty housings, and those which it left to load in another container) ends, it can also estimate the time during which the advance of the machine ta occurs and is able to foresee in which collection positions the objects to be loaded are located over time. Therefore, it will calculate the positioning time tp11, tp12, tp21 and tp22 that the manipulator would take to load each of the objects (a, b, c, d), carrying them directly (taking a rectilinear path seen from above) to each of the loading positions which will correspond to the empty housings of the containers once the advance has ended, and the object to be loaded and the new loading position will be that the positioning time of which is the most similar to the advance time of the machine, which in this case coincides with the available time (unlike in the state of the art, in which the manipulator follows the movement of the housings).

As a result, the method of the invention optimizes productivity of the manipulator since it prevents the excess time necessary for tracking the paths during the advance of the machine.

In a second embodiment, the available time td can be calculated as the sum of the advance time ta and a remaining time $t_{rem}$ for the movement of the containers between a first rest position (1) and at least one second rest position (2) to start.

In this case, product assignment is optimized based on the knowledge that is available with respect to the advance cycle of the machine.

When choosing the object (a, b, c, d) to be collected and determining its loading position, the remaining time $t_{rem}$ is calculated before the start of the movement of the containers and which objects are to be loaded and the loading positions the positioning time of which is less than the time it takes for the advance to start $t_{rem}$ are determined. For example, when the remaining time $t_{rem}$ is greater than any of the positioning times tp11, tp12, tp21, tp22, the object to be collected and the delivery position corresponding to the positioning time that is closest to the remaining time $t_{rem}$ are determined, although as in the previous case, other loading criteria which can be combined with the method of the present invention can also take precedence, such as for example completing the filling of all the housings before they leave the work area (6) of the manipulator, distance criteria with respect to the radius of action of the manipulator, or others.

In the event that the remaining time $t_{rem}$ is less than said positioning times, the calculation is repeated, but taking into consideration the available time after the advance of the containers, i.e., the advance time to plus the remaining time $t_{rem}$, $ta+t_{rem}$.

Finally, the object (a, b, c, d) to be collected and its optimal destination housing are determined by comparing the positioning time tp11, tp12, tp21, tp22 that most closely resembles the available time td, or considering a distance criterion with respect to the radius of action, completing the filling of all the housings, prioritizing the collection of those objects leaving the work area (6) of the manipulator, or others.

In principle, according to this method, it would not be necessary to apply the method of the first embodiment, but cases are possible (due to the difficulty of accurately establishing the performance of the advance of the receptacle) in which the combination of both improves the final result.

The method of the second embodiment differs from the first embodiment in that it is predictive: in the previous case, the manipulator recalculated the loading positions when it detected the advance movement of the machine. In contrast, in this second method, the manipulator will know at all times when the advance of the machine will occur, and depending on the time it has (before or after the advance) it will decide where to deposit the product.

In this case, in the moment in which the manipulator deposits a product in a housing and is going to collect a new product from the collecting area (5), it calculates the time it has for the advance of the machine to occur $t_{rem}$ and the available time it has for the advance of the machine to end $t_{rem}+ta$. It can thus decide which product (a, b, c, d) to collect and in which position to deposit said product, depending on the time it has before the advance, the time it has from that moment to after the advance, or other criteria.

For example, it will choose to collect an object and deposit it in a loading position in the first rest position (1) if there are no housings that will be out of reach of the manipulator once the machine advances or if the remaining time $t_{rem}$ is the most similar to the time it takes the manipulator to collect said object and reach the loading position in the first rest position (1).

The manipulator will choose to collect an object and deposit it in a loading position in the second rest position (2), i.e., the housing in the second rest position after the advance of the container, if the available time at which the advance of the machine ends $t_{rem}+ta$ is the most similar to the time it takes the manipulator to collect said object and directly reach the loading position in the second rest position (2).

In a third embodiment, the loading position corresponds to a position of an empty housing between the first rest position (1) and the second rest position (2), i.e., the manipulator can perform the loading during the movement of the container without it being necessary to wait to be in a rest position.

According to this third embodiment, the available time td is calculated as the sum of the advance time ta and a remaining time $t_{rem}$ for the movement of the containers between the first rest position (1) and the at least one second rest position (2) to start, the available time td being greater than the positioning times tp11, tp12, tp21 and tp22 of each of the objects (a, b, c, d) in the different empty housings of the containers, and the remaining time $t_{rem}$ less than the positioning time tp11, tp12, tp21, tp22, i.e., when the manipulator does not have time to collect and load the object before it starts the advance of the containers but this time is less than the available time for the containers to reach the second rest position. In this case, the manipulator will collect an object and deposit it in a loading position corresponding with an empty housing moving from the first rest position to the second rest position.

This implies that there is communication between the manipulator and the packaging machine, such that the manipulator knows at all times the time it has until the advance, how long the advance will last and exactly where the empty housings will be located throughout the advance process, such that it is possible for it to calculate which object to collect and the best loading position for loading said object which optimizes the performance of the machine-manipulator assembly at all times.

The delivery of the object in the loading position is performed with a substantially nil relative velocity with respect to the container and a shifting direction substantially parallel to the advance direction of the container. The manipulator knows the position of the housing at all times and goes towards a loading position in which it will find the corresponding housing. Once the manipulator is in the vicinity of the loading position, it adapts its velocity and direction such that they substantially coincide with that of the housing in order for the delivery of the product to be performed in the best conditions.

It must be pointed out that the invention is not limited to the product filling field, but rather it is also applicable in any other process performed by manipulators acting on a product which moves intermittently at a variable velocity (welding, palletizing, manipulation, unloading, product selection processes, etc.).

The invention claimed is:

1. A method of loading by the use of a manipulator one or more objects into empty housings of containers located on a packaging machine, the method comprising:

providing the one or more objects in a work area of the manipulator;

intermittently shifting the position of the empty housings by use of the packaging machine between rest positions during an advance time, each of the empty housings residing at the rest positions during a rest time, a rest position located in the work area of the manipulator corresponding with a loading position;

upon detecting an initiation of the empty housings being intermittently shifted between the rest positions, calculating positioning times necessary for the manipulator to load at least one of the one or more objects into the empty housings that are located at the loading positions at the completion of the intermittent shifting of the empty housings;

determining a difference in time between the advance time and the calculated positioning times for the at least one of the one or more objects and the loading positions; and causing the manipulator to deliver the at least one of the one or more objects to the loading position whose positioning time is equal to the advance time or is otherwise the closest to and longer than the advance time.

2. A method according to claim 1, wherein when the initiation of the shifting of the housings is detected and the manipulator has previously collected the at least one of the one or more objects, the calculated positioning times correspond with the time needed by the manipulator to deliver the collected object to each of the loading positions.

3. A method according to claim 1, wherein when the initiation of the shifting of the housings is detected and the manipulator has not previously collected the at least one of the one or more objects, the calculated positioning times correspond with the time needed by the manipulator to collect each of the objects from the work area and to deliver the collected objects to each of the loading positions.

4. A method according to claim 1, wherein the empty housings are shifted between their respective rest positions with a variable velocity throughout the advance time.

5. A method according to claim 1, wherein a portion of the manipulator that carries the one or more objects to the loading positions of the empty housings follows a rectilinear path when delivering the one or more objects to the empty housings.

6. A method of loading by the use of a manipulator one or more objects into empty housings of containers located on a packaging machine, the method comprising:

providing the one or more objects in a work area of the manipulator;

intermittently shifting the position of the empty housings by use of the packaging machine between rest positions during an advance time, each of the empty housings residing at the rest positions during a rest time, a rest position located in the work area of the manipulator corresponding with a loading position;

prior to intermittently shifting the empty housings, calculating the positioning times necessary for the manipulator to collect each of the objects from the work area of the manipulator and to deliver each of the objects to each of the loading positions;

determining a remaining time for the empty housings to start being intermittently shifted between the rest positions;

upon the remaining time being shorter than all calculated positioning times, comparing the positioning times with the corresponding loading times resulting from the addition of the remaining time and the advance time; and causing the manipulator to deliver the object to the loading position whose positioning time is equal to the loading time or is otherwise the closest to and longer than the loading time.

7. A method according to claim 6, wherein the empty housings are shifted between their respective rest positions with a variable velocity throughout the advance time.

8. A method according to claim 6, wherein a portion of the manipulator that carries the one or more objects to the loading positions of the empty housings follows a rectilinear path when delivering the one or more objects to the empty housings.

9. A method of loading by the use of a manipulator one or more objects into empty housings of containers located on a packaging machine, the method comprising:

providing the one or more objects in a work area of the manipulator;

intermittently shifting the position of the empty housings by use of the packaging machine between rest positions during an advance time, each of the empty housings residing at the rest positions during a rest time, an empty housing located in the work area of the manipulator corresponding with a loading position, being the loading position in a rest position or being moved during the intermittent shifting of the empty housings;

calculating a positioning time necessary for the manipulator to collect each of the one or more objects from the work area of the manipulator and to deliver each of the objects to each of the loading positions corresponding to the rest positions;

determining a remaining time for the empty housings to start being intermittently shifted;

if the remaining time is shorter than all calculated positioning times, calculating new positioning times to deliver each of the objects to the loading positions of the empty housings during the intermittent shifting of the empty housings; and causing the manipulator to deliver the object to loading position corresponding with the shortest positioning time during the intermittent shifting of the empty housings.

10. A method according to claim 9, wherein the empty housings are shifted between their respective rest positions with a variable velocity throughout the advance time.

11. A method according to claim 9, wherein a portion of the manipulator that carries the one or more objects to the loading positions of the empty housings follows a rectilinear path when delivering the one or more objects to the empty housings.

12. A method according to claim 9, wherein the velocity and movement of the manipulator is synchronized to the velocity and movement of the empty housings when the object to be delivered to the loading position is arriving to the loading position.

* * * * *